US007769196B2

(12) United States Patent
Wang

(10) Patent No.: US 7,769,196 B2
(45) Date of Patent: Aug. 3, 2010

(54) MICROPHONE SHELL

(75) Inventor: Hung-Chi Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1105 days.

(21) Appl. No.: 11/439,977

(22) Filed: May 25, 2006

(65) Prior Publication Data

US 2007/0201716 A1 Aug. 30, 2007

(30) Foreign Application Priority Data

Feb. 24, 2006 (TW) ..... 95203106 U

(51) Int. Cl.
*H04R 21/02* (2006.01)
*H04R 25/00* (2006.01)
*H01R 13/62* (2006.01)

(52) U.S. Cl. ..... 381/365; 381/189; 439/366; 439/370

(58) Field of Classification Search ..... 381/91, 381/189, 355, 361, 365, 394; 439/77, 345, 439/346, 349, 366, 367, 370, 372, 607.1–607.04; D8/352; D13/133, 146, 154; D14/217, 225, D14/229; 379/433.03, 438; 181/148, 150
See application file for complete search history.

(56) References Cited

U.S. PATENT DOCUMENTS

| | | | | |
|---|---|---|---|---|
| 6,597,793 | B1 * | 7/2003 | Darbut et al. | 381/355 |
| 6,675,930 | B2 * | 1/2004 | Sugiyama et al. | 181/148 |
| 2002/0131615 | A1 * | 9/2002 | Komiyama et al. | 381/355 |
| 2005/0002538 | A1 * | 1/2005 | Yonehara et al. | 381/355 |

* cited by examiner

*Primary Examiner*—Curtis Kuntz
*Assistant Examiner*—Jesse A Elbin
(74) *Attorney, Agent, or Firm*—Rosenberg, Klein & Lee

(57) ABSTRACT

A microphone shell includes a top wall and a side wall extending downwardly from peripheral area of the top wall. A receiving room is formed between the top wall and the side wall for containing a microphone soldered with a printed circuit board, and a through hole arranged on center of the top wall. Voice is transmitted only through the through hole and gathered in the receiving room of the microphone shell, and then received by the microphone. In addition the microphone receives no external noise because the microphone shell covers the microphone and obstructs the external noise. Therefore, the microphone shell not only gathers voice but also obstructs noise.

2 Claims, 5 Drawing Sheets

MICROPHONE SHELL

BACKGROUND OF THE INVENTION

1. Field of the Invention

The invention relates to a microphone shell, and particularly to a microphone shell capable of gathering voice and obstructing noise for applying to consumer products such as mobile phones, personal digital assistants (PDA), etc.

2. The Related Art

With rapid development of electrical technology, a microphone capable of transmitting voice is applied to various portable electrical devices such as mobile phones, PDAs, etc. Accordingly, microphone connectors are necessarily for these devices.

Please refer to FIG. 5, a conventional microphone connector 6 for consumer products including a plastic housing 61 having a receiving room 62. A plurality of connectors 63 are arranged at the receiving room 62. One end of each connector 63 is inclined and projected to form a contact portion 631 in the receiving room 62. The other end of each connector 63 extends outwardly from the plastic housing 61 to form a soldering portion 632. The microphone connector 6 is disposed on a printed circuit board (not shown) for the portable electrical devices such as a mobile phone. The receiving room 62 of the microphone connector 6 contains a microphone 5. The contact portion 631 of the microphone connector 6 contacts a contact portion (not shown) of the microphone 5, and the soldering portion 632 of the microphone connector 6 is soldered to the printed circuit board.

However, the microphone connector 6 has no structure to gather voice signal and obstruct noise signal, therefore, the voice signal is transmitted with the noise signal to the microphone 5. That is, the microphone 5 receives unavailable signal because of the noise signal.

SUMMARY OF THE INVENTION

An object of the present invention is to provide a microphone shell not only gathering voice but also obstructing noise.

According to the invention, the microphone shell includes a top wall, a through hole arranged at center of the top wall and a side wall extending downwardly from peripheral area of the top wall. A receiving room is formed between the top wall and the side wall for containing a microphone arranged on a printed circuit board. Voice is transmitted only through the through hole and gathered in the receiving room of the microphone shell, and then received by the microphone. In addition, according to the microphone shell covers the microphone and obstructs the noise, the microphone receiving no noise externally. In this case, the microphone shell not only gathers voice but also obstructs noise.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
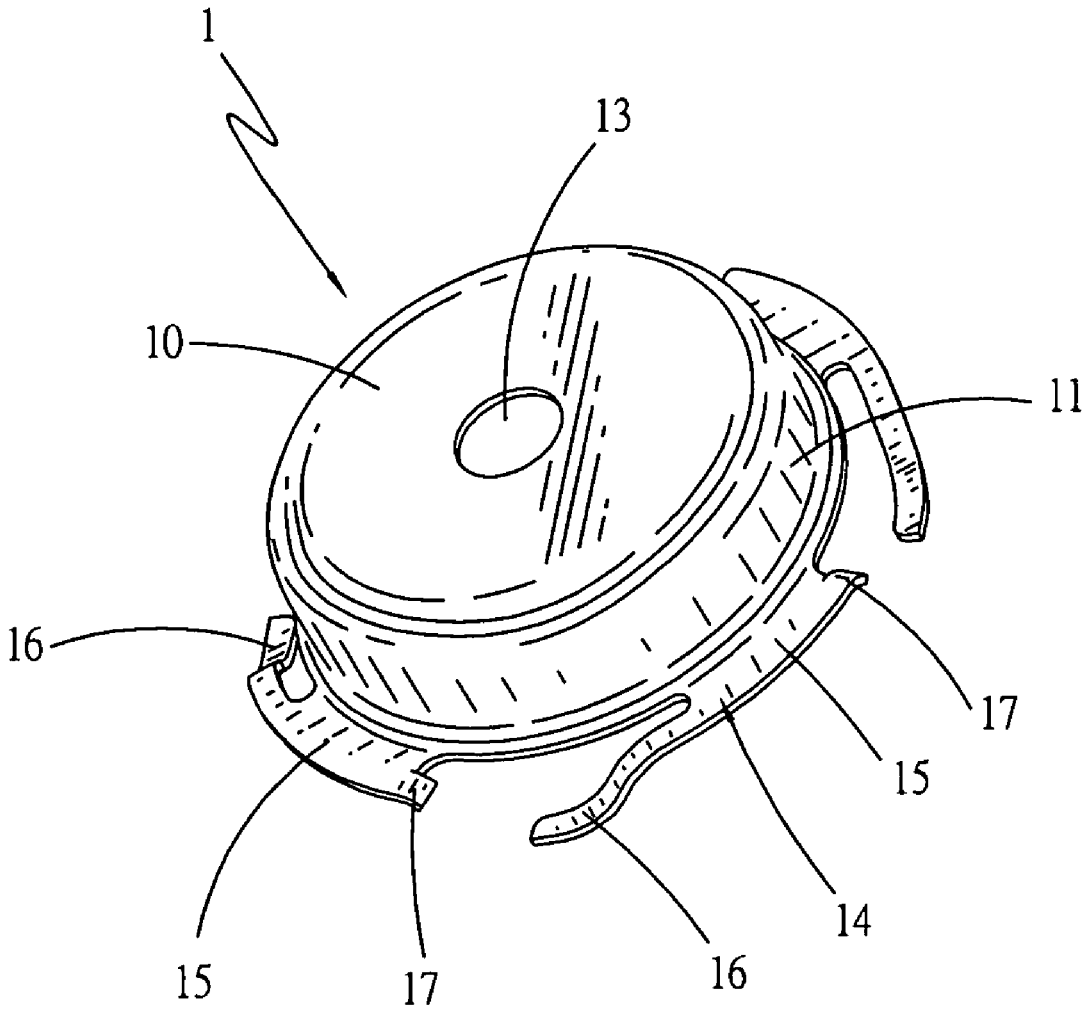
FIG. 1 is a perspective view of a microphone shell according to the present invention.
Figure 4:
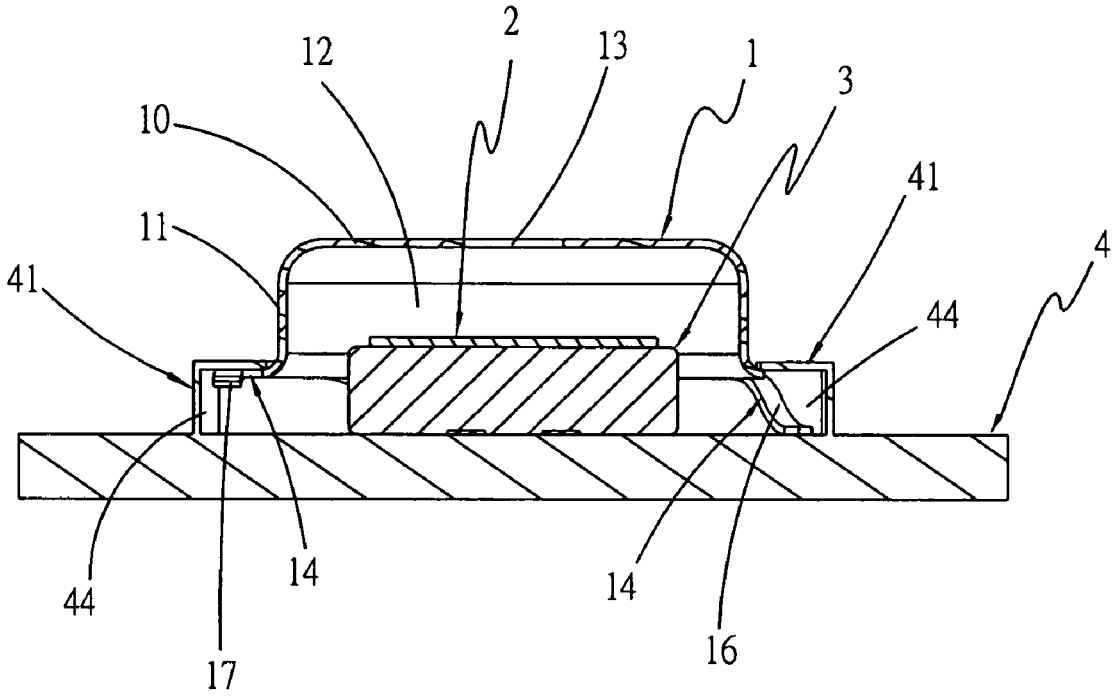
FIG. 4 is a cross-sectional view of the microphone shell arranged on the printed circuit board taken along line IV-IV in FIG. 3.
Figure 5:
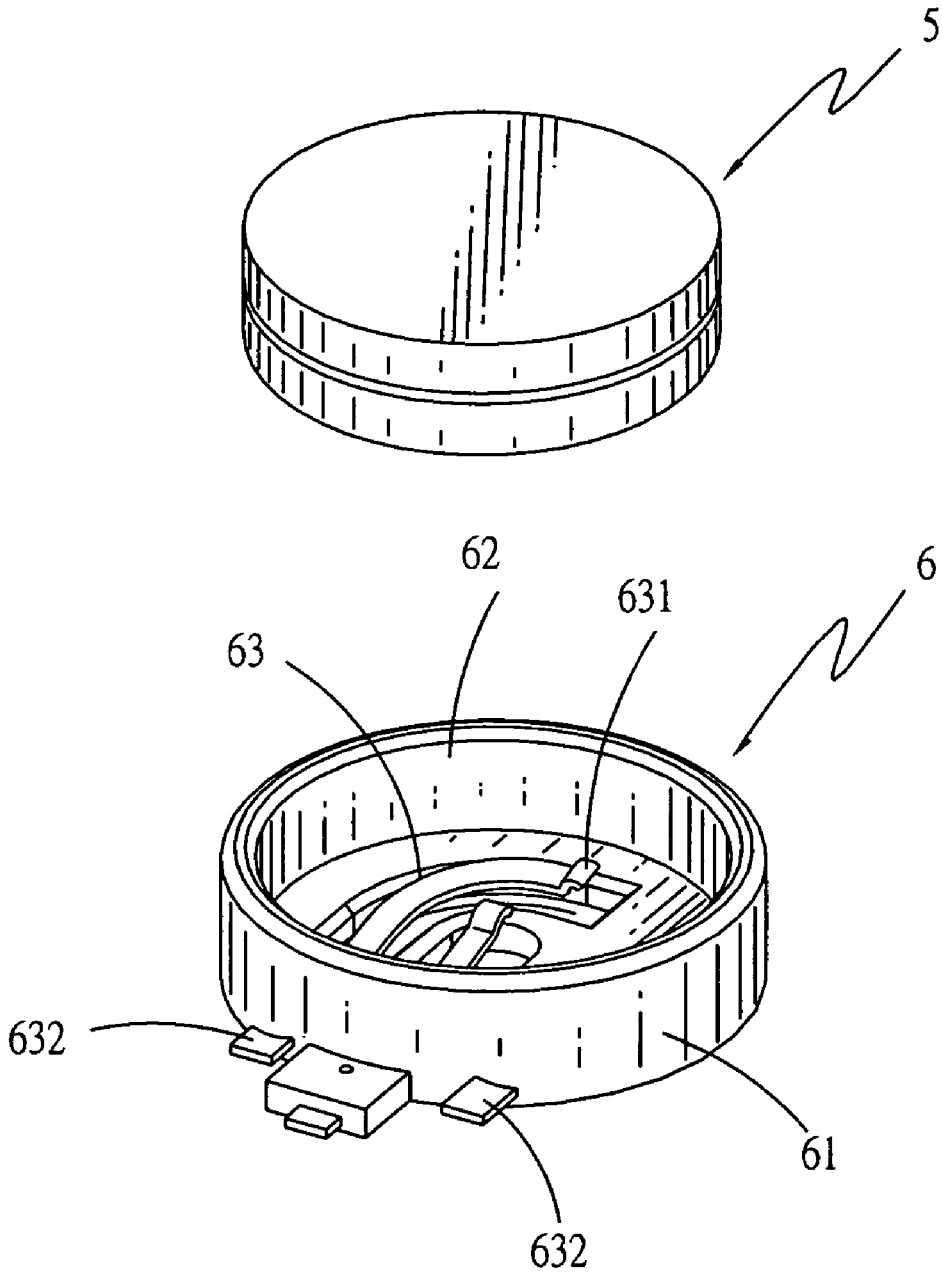
FIG. 5 (Prior Art)
FIG. 5 is a perspective view of a conventional microphone connector showing a microphone connector containing a microphone.

Referring to FIG. 1 and FIG. 4, a preferred embodiment of a microphone shell 1 according to the present invention is shown in FIG. 1. The microphone shell 1 is applied to a mobile phone (not shown). The microphone shell 1 is arranged in the mobile phone and covers a microphone 2. The microphone 2 is contained in a microphone connector 3 being soldered to a printed circuit board (PCB) 4 in the mobile phone.

Figure 2:
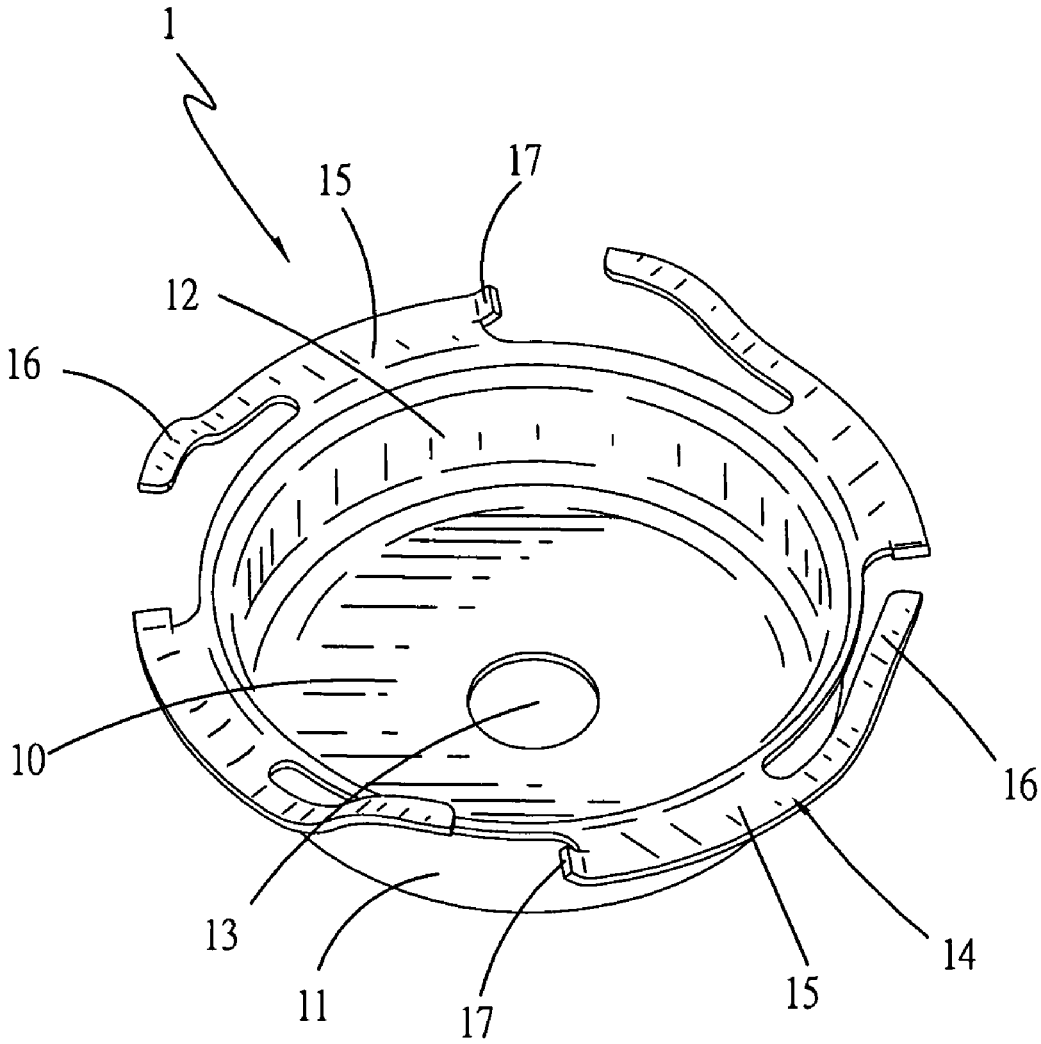
FIG. 2 is a perspective view of the microphone shell viewing from bottom side.

Please referring to FIG. 1 and FIG. 2. The microphone shell 1 includes a top wall 10 and a side wall 11 extending downwardly from peripheral area of the top wall 10. A receiving room 12 is formed between the top wall 10 and the side wall 11 for covering the microphone 2 being arranged at the PCB 4 and a through hole 13 is arranged at center of the top wall 10. An engagement device 14 is arranged at a periphery of the side wall 11 for engaging with the PCB 4. The engagement device 14 includes a fixing body 15 horizontally extending from a bottom of the periphery of the side wall 11. One end of the fixing body 15 extends downwardly to form a resilient portion 16. The other end of the fixing body 15 bends downwardly to form a guiding portion 17.

One method for fixing the microphone shell 1 in the mobile phone is that the microphone shell 1 covers the microphone 2, and then is fixed between the PCB 4 and a housing of the mobile phone via pressure force from the PCB 4 and from the housing of the mobile phone when the printed circuit board is fixed to the housing of the mobile phone.

Figure 3:
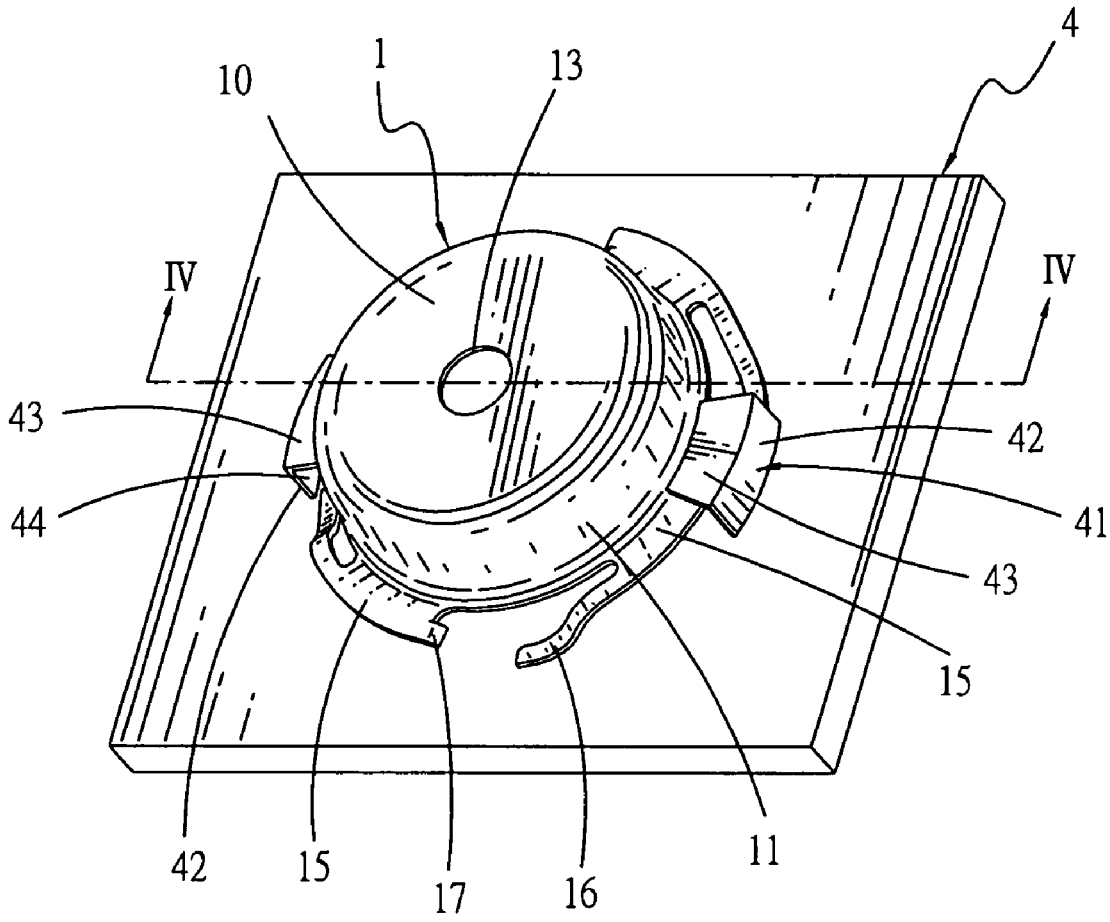
FIG. 3 is a perspective view of the microphone shell showing the microphone shell arranged on a printed circuit board.

Referring to FIG. 3, another method for fixing the microphone shell 1 in the mobile phone is that the microphone shell 1 covers the microphone 2 and engages with the PCB 4 by the engagement device 14 engaging with at least one latch device 41 located on the PCB 4. For example, the latch device 41 includes a supporting wall 42 arranged on the PCB 4 and a block wall 43 bent and extended inwardly from free end of the supporting wall 42. An engagement space 44 is formed between the supporting wall 42 and the block wall 43. The engagement device 14 of the microphone shell 1 is engaged with the latch device 41 located on the PCB 4 in order to fix the microphone shell 1 and the PCB 4. That is, the fixing body 15 of the engagement device 14 is smoothly inserted into the engagement space 44 of the latch device 41 via the guiding portion 17 of the engagement device 14 by rotating the microphone shell 1. According to an upward pressure formed by the resilient portion 16 of the engagement device 14 being pressed onto the PCB 4, the fixing body 15 of the engagement device 14 is engaged with the block wall 43 of the latch device 41 located on the PCB 4. So that, the microphone shell 1 is fixed on the PCB 4 in the mobile phone.

Since external voice signal is transmitted and gathered in the receiving room 12 only through the through hole 13 of the microphone shell 1 and then received by the microphone 2, microphone 2 receives no external noise signal according to the microphone shell 1 covers the microphone 2. That is, the microphone shell 1 capable of not only gathering external voice signal but also obstructing external noise signal.

The foregoing description of various implementations has been presented for the purposes of illustration and description. It is not intended to be exhaustive or to limit the scope to the precise form disclosed. Many modifications and variations are possible in light of the above teaching. Such modifications and variations are intended to be included within the scope of this invention as defined by the accompanying claims.

What is claimed is:

1. A microphone shell comprising:

a top wall;

a side wall extending downwardly from peripheral area of said top wall;

at least one engagement device arranged at a periphery of said side wall for engaging with a printed circuit board, said engagement device having a fixing body horizontally extending from a bottom of periphery of said side wall, one end of said fixing body extending downwardly to form a resilient portion for pressing said printed circuit board, the other end of said fixing body bending downwardly to form a guiding portion;

a receiving room formed between said top wall and said side wall for covering a microphone connector arranged at said printed circuit board; and a through hole arranged at said top wall for allowing voice being transmitted therethrough.

2. The microphone shell as claimed in claim 1, further comprising at least one latch device located on said printed circuit board for engaging with said engagement device, said latch device having a supporting wall for receiving said engagement device to secure said microphone cell while said fixing body being engaged with said latch device and said resilient portion being pressed onto said printed circuit board.

* * * * *